US008525730B2

(12) United States Patent
Christian et al.

(10) Patent No.: US 8,525,730 B2
(45) Date of Patent: Sep. 3, 2013

(54) MULTI-BAND PRINTED CIRCUIT BOARD ANTENNA AND METHOD OF MANUFACTURING THE SAME

(75) Inventors: Rene Christian, Arden Hills, MN (US); Bernard Sandler, Brookfield, WI (US)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 843 days.

(21) Appl. No.: 12/645,246

(22) Filed: Dec. 22, 2009

(65) Prior Publication Data

US 2010/0245181 A1 Sep. 30, 2010

Related U.S. Application Data

(60) Provisional application No. 61/163,022, filed on Mar. 24, 2009.

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702, 795
See application file for complete search history.

(56) References Cited

U.S. PATENT DOCUMENTS

| | | | | |
|---|---|---|---|---|
| 4,578,654 | A | 3/1986 | Tait | |
| 5,541,610 | A * | 7/1996 | Imanishi et al. | 343/702 |
| 5,550,554 | A * | 8/1996 | Erkocevic | 343/828 |
| 6,535,170 | B2 * | 3/2003 | Sawamura et al. | 343/702 |
| 7,218,282 | B2 * | 5/2007 | Humpfer et al. | 343/700 MS |
| 7,405,699 | B2 * | 7/2008 | Qin | 343/700 MS |
| 7,405,704 | B1 | 7/2008 | Lin et al. | |
| 7,432,865 | B2 * | 10/2008 | Tsai et al. | 343/702 |
| 7,825,863 | B2 * | 11/2010 | Martiskainen et al. | 343/702 |
| 2005/0156796 | A1 | 7/2005 | Nysen | |
| 2009/0243942 | A1 | 10/2009 | Autti | |

FOREIGN PATENT DOCUMENTS

| | | | |
|---|---|---|---|
| EP | 1011167 | A1 | 6/2000 |
| EP | 1324425 | A1 | 7/2003 |
| WO | 2005076407 | A2 | 8/2005 |

OTHER PUBLICATIONS

European Search Report for EP10156811; dated Jul. 21, 2010; 5 pages.

* cited by examiner

*Primary Examiner* — Tan Ho
(74) *Attorney, Agent, or Firm* — MH2 Technology Law Group LLP

(57) ABSTRACT

A multi-band antenna for a printed circuit board (PCB). The PCB multi-band antenna comprises a first trace coupled to a first surface of the PCB extending along at least a portion of a length of a first side of the PCB and along at least a portion of a length of a second side of the PCB that intersects the first side, wherein the first trace is positioned proximate a perimeter of the PCB that is partially defined by the first side and the second side.

18 Claims, 11 Drawing Sheets

MULTI-BAND PRINTED CIRCUIT BOARD ANTENNA AND METHOD OF MANUFACTURING THE SAME

CROSS REFERENCE TO RELATED APPLICATION

This patent application claims priority, and the benefit of, U.S. Provisional Patent Application Ser. No. 61/163,022 filed on Mar. 24, 2009, the entirety of which is hereby incorporated by reference.

BACKGROUND OF THE INVENTION

1. Field of the Invention

The embodiments described herein are related to a multi-band printed circuit board antenna and, more particularly, to a multi-band printed circuit board antenna with a first trace operative in a low frequency band on a first surface of the printed circuit board, and a second trace operative in a high frequency band on an opposing second surface of the printed circuit board.

2. Description of the Related Art

Portable communication devices that communicate with wireless services frequently operate in different frequency bands. Different frequency bands may be used, for example, in different geographical regions, for different wireless providers, and for different wireless services. Pagers, data terminals, mobile phones, other wireless devices and combined function wireless devices therefore often require an antenna or multiple antennas responsive to multiple frequency bands. As an example of a need for multi-band reception and transmission, at least some "world" mobile phones must accommodate the following bands: Global System for Mobile Communication or Group Special Mobile (GSM); Digital Cellular Systems (DCS); and Personal Communication Services (PCS).

Although there are several designs available for external multi-band antennas, conventional portable communication devices house antennas internally or within a device housing on a printed circuit board (PCB). However, conventional PCB antennas are incapable of achieving four bandwidths, such as 850 MHz, 900 MHz, 1800 MHz, and 1900 MHz simultaneously. Further, conventional PCB antennas cannot achieve very low bandwidths, such as 824 MHz, without extending an antenna to interact with further components within a device. One factor causing conventional PCB antennas to be incapable of achieving multi-band capabilities is that traces on conventional PCB antennas include more than four bends (e.g., four 90° turns) forming, for example, a spiral shape. However, the more bends a trace makes, the less effective of a radiator it will be because the trace will interact with material in the PCB and therefore dissipate more energy into the PCB rather than radiating the energy.

FIG. 12 is an example of a conventional system 1200 designed to transfer a ground to a motherboard 1202. Conventional apparatus 1200 comprises two coax cables 1204 and 1205 and an antenna 1206 with a ground end soldered to a ground of a motherboard 1202. In addition, a coax cable ground 1210 is soldered to an edge of the motherboard 1202, thus allowing only a center conductor to make contact with a base of antenna 1206. Conventional apparatus have several problems when connecting, for example, antenna 1206 to a radio 1212. For example, radio 1212 is a secondary PCB having a ground that is poorly connected to motherboard 1202.

Additionally, conventional apparatuses neglect an effect of a coax cable. Therefore, unless there is a balun at the base of the antenna or unless the antenna is fed with a truly differential transmission line, radio frequency currents flow on an outside of the coax cable and radiate, which is undesirable.

BRIEF DESCRIPTION OF THE INVENTION

In one aspect, a multi-band antenna for a printed circuit board (PCB) is provided. The multi-band antenna comprises a first trace coupled to a first surface of the PCB and extending along at least a portion of a length of a first side of the PCB and along at least a portion of a length of a second side of the PCB intersecting the first side, wherein the first trace is positioned proximate a perimeter of the PCB partially defined by the first side and the second side.

In a further aspect, a communication device is provided. The communication device comprises a printed circuit board (PCB) having a perimeter at least partially defined by a first side, a second side, and a third side. An antenna is coupled to the PCB, and comprises a first trace of conductive material coupled to a first surface of the PCB. The first trace extends along at least a portion of a length of the first side proximate the perimeter and at least a portion of a length of the second side proximate the perimeter. A second trace of conductive material is coupled to a second surface of the PCB opposing the first surface. The second trace extends along at least a portion of a length of the third side proximate the perimeter and along at least a portion of the length of the second side proximate the perimeter.

In yet another aspect, a method is provided for manufacturing a multi-band antenna that is coupled to a printed circuit board (PCB) having a perimeter at least partially defined by a first side, a second side, and a third side. The method comprises forming a first trace of conductive material on a first surface of the PCB. The first trace extends along at least a portion of a length of the first side proximate the perimeter and at least a portion of a length of the second side proximate the perimeter. A second trace of conductive material is formed on a second surface of the PCB. The second trace extends along at least a portion of a length of the third side proximate the perimeter and at least a portion of a length of the second side proximate the perimeter.

In yet another aspect, a two sided antenna is provided. The two sided antenna comprises a dielectric substrate having a first surface and a second surface. A first radiator is positioned on the first surface and is configured to radiate a first frequency band. A second radiator is positioned on the second surface to overlap the first radiator and is configured to radiate a second frequency band. The overlap allows a weak coupling to occur between the first radiator and the second radiator, and to combine with the dielectric material and a band to split a resonate mode.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION OF THE INVENTION

Figure 1:
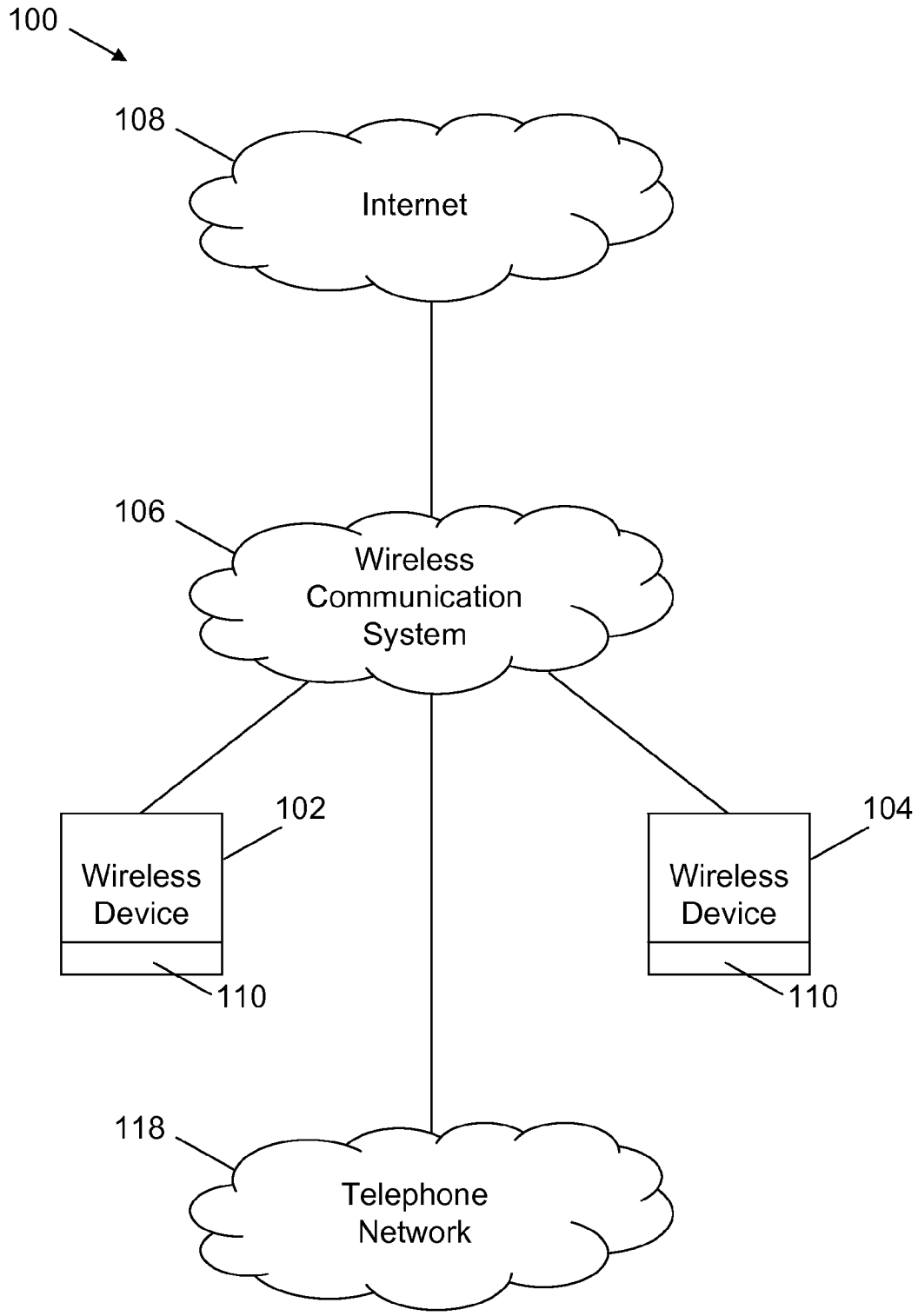
FIG. 1 is a block diagram of an exemplary wireless communication network.

Referring initially to FIG. 1, a block diagram of an exemplary wireless communication network is shown and designated generally as wireless network 100. In one embodiment, wireless network 100 may be any wireless communication network that comprises two or more wireless communication devices 102 and 104. Wireless network 100 may be used to communicate any type or combination of information in any suitable format including, without limitation, audio, video, and/or data format. In one embodiment, communication devices 102 and 104 can communicate either directly or indirectly (e.g., through one or more of wireless devices 102 and 104 acting as a wireless router) with a wireless communication system 106, although such communication is not required.

Additionally, wireless communication system 106 may be any publicly accessible or any proprietary system, and can use any appropriate access and/or link protocol to communicate with wireless communication devices 102 and 104 including, without limitation, analog, digital, packet-based, time division multiple access (TDMA), code division multiple access (CDMA), such as direct sequence CDMA, frequency hopping CDMA, wideband code division multiple access (WCDMA), frequency division multiple access (FDMA), spread spectrum or any other known or developed access or link protocol or methodology. The wireless communication system 106 can further use any of a variety of networking protocols, such as, for example, User Datagram Protocol (UDP), Transmission Control Protocol/Internet Protocol (TCP/IP), APPLETALK, Inter-Packet Exchange/Sequential Packet Exchange (IPX/SPX), Network Basic Input Output System (Net BIOS), or any proprietary or non-proprietary protocol, to communicate digital voice, data and/or video information with wireless devices 102 and 104 and/or other networks to which wireless communication system 106 can be connected. For example, wireless communication system 106 can be connected to one or more wide area networks, such as Internet 108 and/or a public switched telephone network 118.

Each wireless communication device 102 and 104 can be, for example, a cellular telephone, a mobile data terminal, a two-way radio, a personal digital assistant (PDA), a handheld computer, a laptop or notebook computer, a wireless e-mail device, a two way messaging device, or any combination thereof which has been modified or fabricated to include functionality of the described subject matter. In the following description, the term "wireless communication device" refers to any of the devices mentioned above and any suitable device that operates in accordance with the described subject matter.

Each wireless communication device 102 and 104 as shown comprises at least one embodiment of a multi-band printed circuit board (PCB) antenna 110, together with various other components as described in more detail below with respect to FIG. 2. Multi-band PCB antenna 110 is configured to receive and transmit messages and other signals in at least one low frequency band and in at least one high frequency band. In one embodiment, multi-band PCB antenna 110 is also covered by a protective shell (not shown), such as a shroud.

Figure 2:
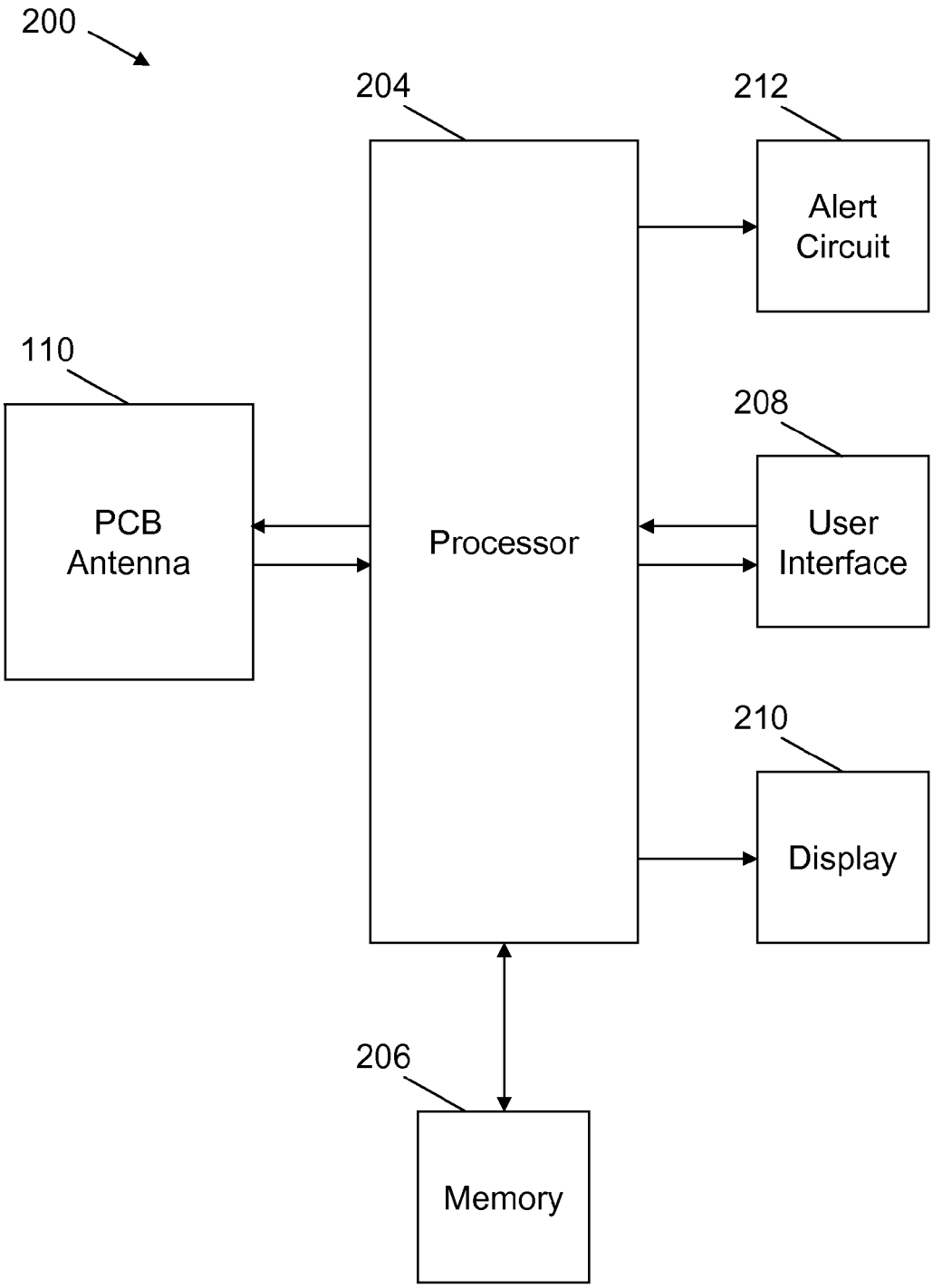
FIG. 2 is a block diagram of an exemplary wireless communication device.

Referring now to FIG. 2, a block diagram of an exemplary wireless communication device operating in wireless communication network 100 is shown and designated generally as wireless communication device 200. In one embodiment, all communication devices in wireless network 100 may be configured in a manner identical to or at least substantially similar to the configuration of wireless communication device 200.

Wireless communication device 200 comprises the aforementioned multi-band PCB antenna 110 and a processor 204, a memory 206, and a user interface 208. In one embodiment, wireless communication device 200 further comprises a display 210 and/or an alert circuit 212, as well as other conventional components (not shown).

As noted above, the exemplary multi-band PCB antenna 110 is configured to transmit message signals to and/or receive message signals from another wireless device and/or wireless communication system 106. The message signals can be, for example, radio signals, and/or modulated audio, video, and/or data signals. In one embodiment, the message signals are communicated over pre-established channels within a selected frequency band, for example, frequency bands established by Global System for Mobile Communication or Group Special Mobile (GSM) (e.g., 824 MHz, 850 MHz, and 900 MHz); Digital Cellular Systems (DCS) (e.g., 1800 MHz); and Personal Communication Services (PCS) (e.g., 1900 MHz). Unlike conventional PCB antennas, multi-band PCB antenna 110 described herein is capable of having enough bandwidth to switch between two frequency bands and four frequency bands, for example, two low frequency bands and two high frequency bands.

In one embodiment, multi-band PCB antenna 110 employs demodulation techniques for receiving incoming message signals transmitted by another wireless device or by communication system 106, as well as modulation and amplification techniques to convey outgoing message signals to other communication devices and/or wireless communication system 106. In one embodiment, processor 204 is configured to send message signals to another communication device or wireless communication system 106 via multi-band PCB antenna 110. The transmitted message signal can, for example, comprise one or more data packets containing radio signals, audio, textual, graphic, and/or video information.

Figure 3:
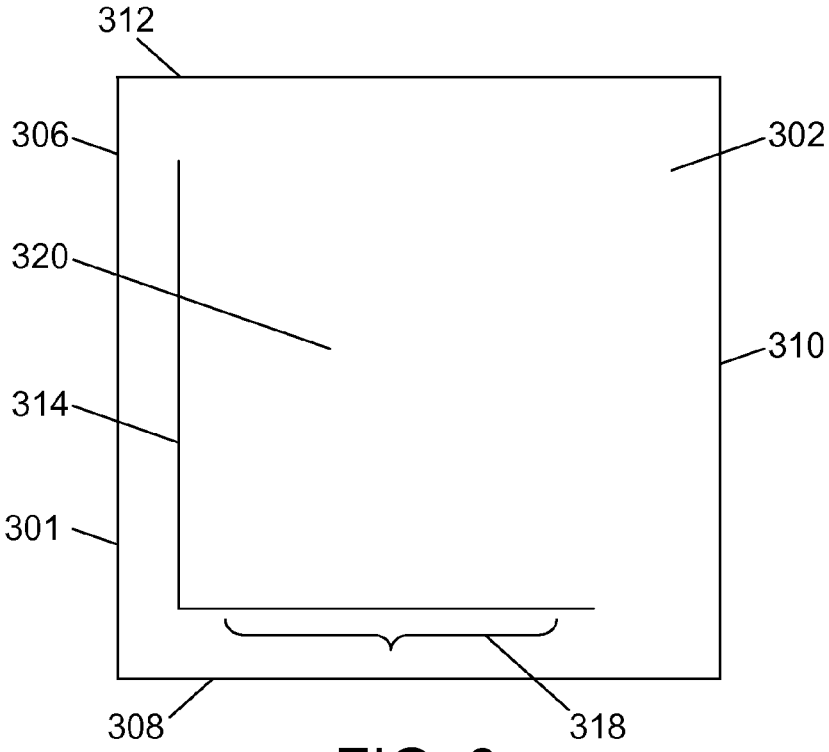
FIG. 3 is a schematic view of a first surface of an exemplary printed circuit board including a first trace.
Figure 4:
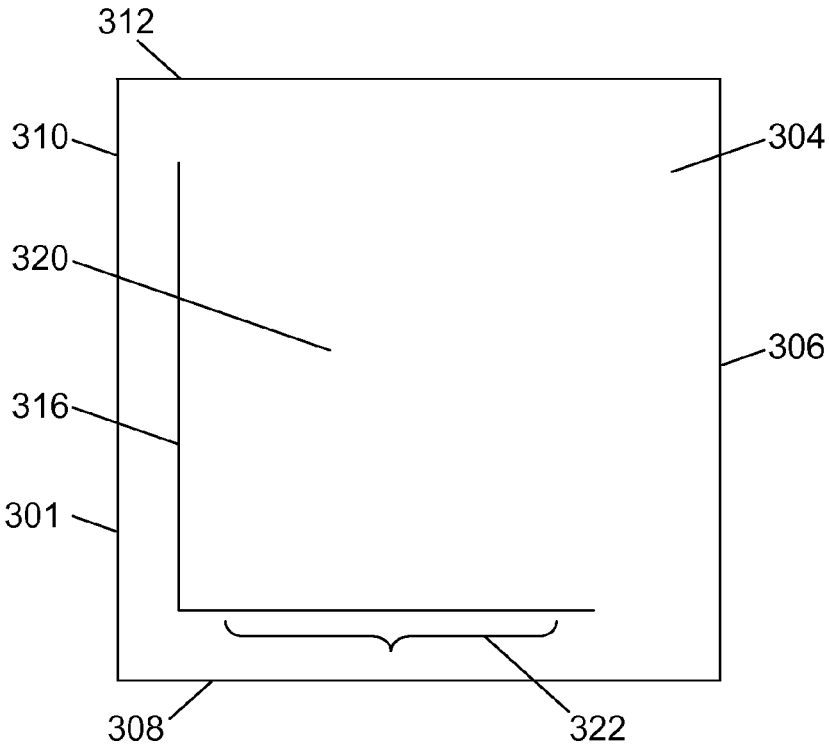
FIG. 4 is a schematic view of a second surface of an exemplary printed circuit board including a second trace.

Referring to FIGS. 3 and 4, multi-band PCB antenna 110 comprises a first surface 302 and an opposing second surface 304. A first side 306, a second side 308, a third side 310, and a fourth side 312 at least partially define a periphery of PCB 320. Although PCB 320 is shown in FIGS. 3 and 4 as a rectangle, PCB 320 may have any suitable shape and/or configuration including, without limitation, any suitable polygon, circular or other suitable shape and/or configuration.

In one embodiment, first surface 302 comprises a first trace 314 of conductive material coupled to and extending along, or with respect to, at least a portion of a length of first side 306 proximate to, e.g., at or near, perimeter 301 of PCB 320 and at least a portion of a length of second side 308 intersecting the first 306. In one embodiment, first trace 314 is printed on first surface 302 and comprises a conducting material made of at least one of the following: copper and/or enig plated (which is Electroless), and gold plated over nickel (which prevents oxidation and maintains high conductivity, low resistivity, and therefore high antenna efficiency). Thus, unlike conventional traces that form a spiral shape, or comprise multiple bends (e.g., five or more bends at 90°) without extending along perimeter of two or more sides of a PCB antenna, such as shown in FIG. 3, first trace 314 bends one time and extends along the length of first side 306 and the length of second side 308 along perimeter 301 of PCB 320. Thus, utilizing the outer perimeter 301 of PCB 320, first trace 314 only requires one bend. It has been found by the inventors of the present disclosure, that the less bends a trace has, the less the trace will interact with material in PCB 320, and therefore, less energy will dissipate into PCB 320 and more energy will be radiated. Radiation of energy (e.g., power) is desirable because energy is not reflected back toward a generator. Further, the number of bends a particular trace may have depends upon a length of a trace and/or one or more dimensions of PCB 320. In a particular embodiment, PCB 320 has a measured length relative to the length shown in FIGS. 3 and 4 sufficient to comprise a substantially linear trace having no bends to facilitate radiating energy through an antenna.

An antenna is a reciprocal device, meaning an antenna performs equally well at the same frequency whether it is used as a receive antenna or a transmit antenna. In the embodiments described herein, an antenna is characterized as a receive antenna, and therefore return loss (e.g., the ratio of power reflected by the antenna divided by the total power sent to the antenna) measured in decibels (dB) is used as an indicator of antenna performance. As a relative measurement, transmitted power and received power may be measured in one direction and may be equal to a total radiated power.

In a further embodiment, second surface 304, as shown in FIG. 4, comprises a second trace 316 of conductive material coupled to second surface 304 and extending along or with respect to at least a portion of a length of third side 310 proximate to, e.g., at or near, perimeter 301 of PCB 320 and at least a portion of the length of second side 308 proximate to, e.g., at or near, perimeter 301 of PCB 320. In a particular embodiment second trace 316 is printed on second surface 304 and includes a suitable conducting material, such as described above in reference to first trace 304. Similar to first trace 314, unlike conventional traces, second trace 316 comprises only one bend in the embodiment as shown in FIGS. 3 and 4. In one embodiment, a portion 318 of first trace 314 overlaps a portion 322 of second trace 316. The overlap of the portion of first trace 314 and second trace 316 provides a weak coupling between first trace 314 and second trace 316, thus allowing an interaction between first trace 314 and second trace 316 that further enhances an ability of multi-band PCB antenna 110 to achieve multi-band frequencies, such as 824 MHz, 850 MHz, 900 MHz, 1800 MHz, and 1900 MHz without a need for interaction with another component within wireless communication device 200. However, excessive overlap may result in a large increase in coupling which will result in excessive resonant mode splitting that is undesirable. In addition, too little overlap and mode splitting will achieve such a small amount of coupling, if any, that the coupling is not distinguishable from, for example, two independent widely separated traces, and thus provides no interaction between the traces. However, when first trace 314 and second trace 316 achieve an appropriate overlap, the appropriate overlap is precisely tuned so as to provide a suitable amount of coupling between resonances. When this occurs, a proper amount of mode splitting also occurs.

Bandwidth of an antenna is a function of the proximity to the ground. In certain embodiments, multi-band PCB antenna 110 may be oriented parallel to a ground plane or perpendicular to the ground plane. However, when an antenna, for example, multi-band PCB antenna 110 is oriented parallel to the ground plane, the closer the antenna is located to ground the narrower radiation bandwidth the antenna will have and the poorer the radiator the antenna becomes, and thus conventionally, this was not possible. However, by taking advantage of mode splitting due to the weak coupling between resonators (e.g., antenna, traces, and radiators), as described above, it is possible to achieve a higher bandwidth antenna in a smaller space because the bandwidth of each mode actually widens, and therefore, a multi-band antenna that is parallel to the ground plane is now possible.

Figure 5:
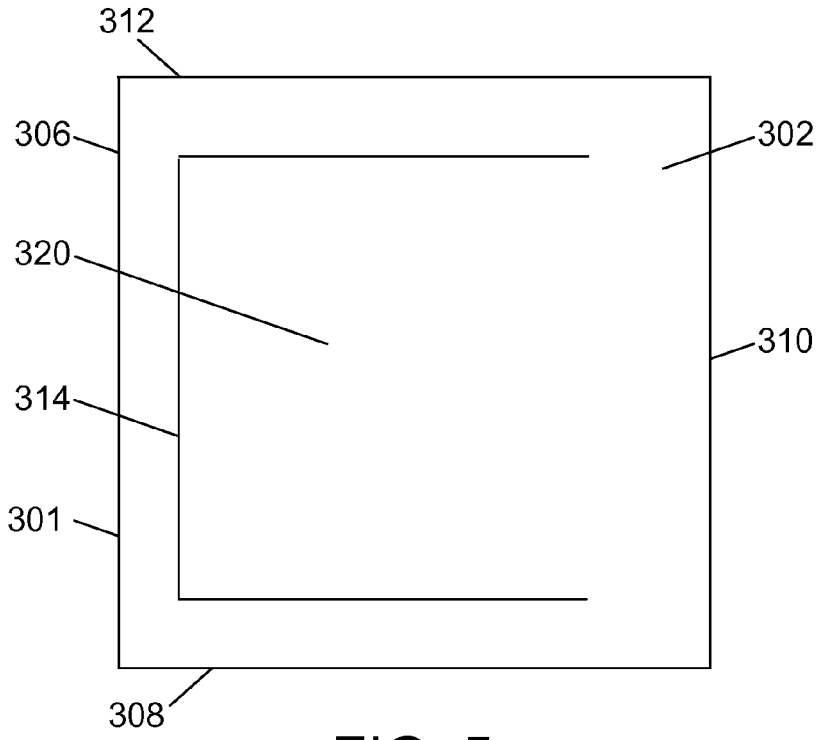
FIG. 5 is a schematic view of a first surface of an exemplary printed circuit board including a first trace.
Figure 6:
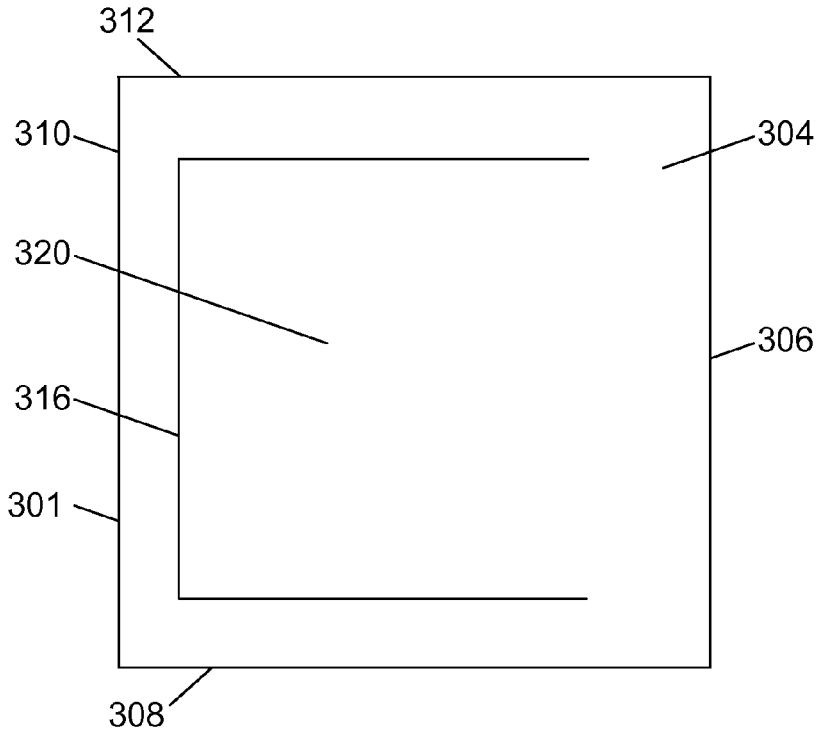
FIG. 6 is a schematic view of a second surface of an exemplary printed circuit board including a second trace.

FIGS. 5 and 6 show an alternative embodiment of a multi-band antenna 110 coupled to a PCB, for example, PCB 320. PCB 320 comprises first surface 302 having first trace 314 extending along at least a portion of the length of first side 306, at least a portion of the length of second side 308, and at least a portion of a length of fourth side 312. Referring further to FIG. 6, second surface 304 may comprise second trace 316 extending along at least a portion of the length of second side 308, at least a portion of the length of third side 310, and at least a portion of the length of fourth side 312.

Figure 7:
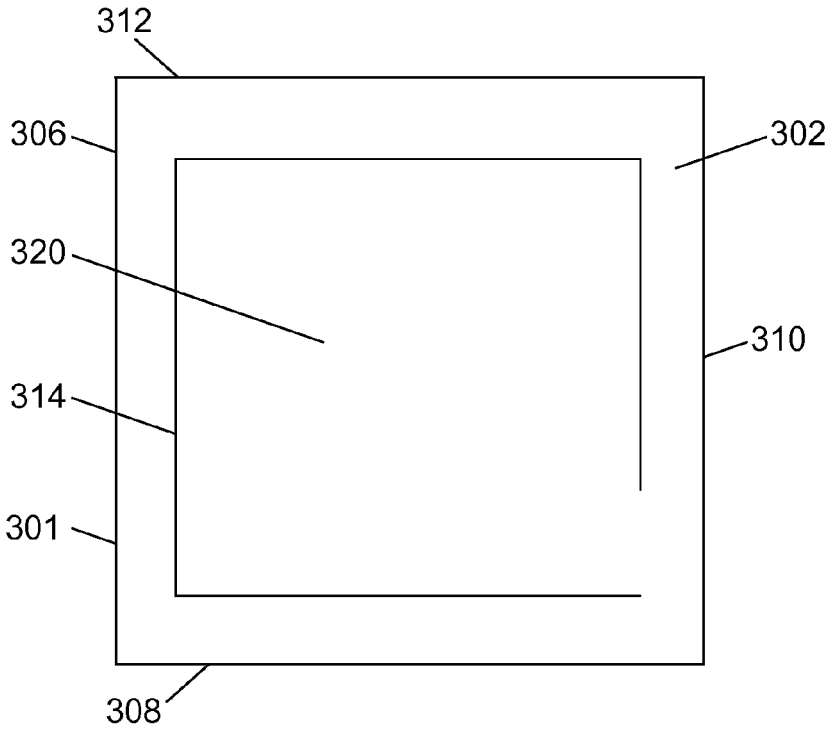
FIG. 7 is a schematic view of a first surface of an exemplary printed circuit board including a first trace.
Figure 8:
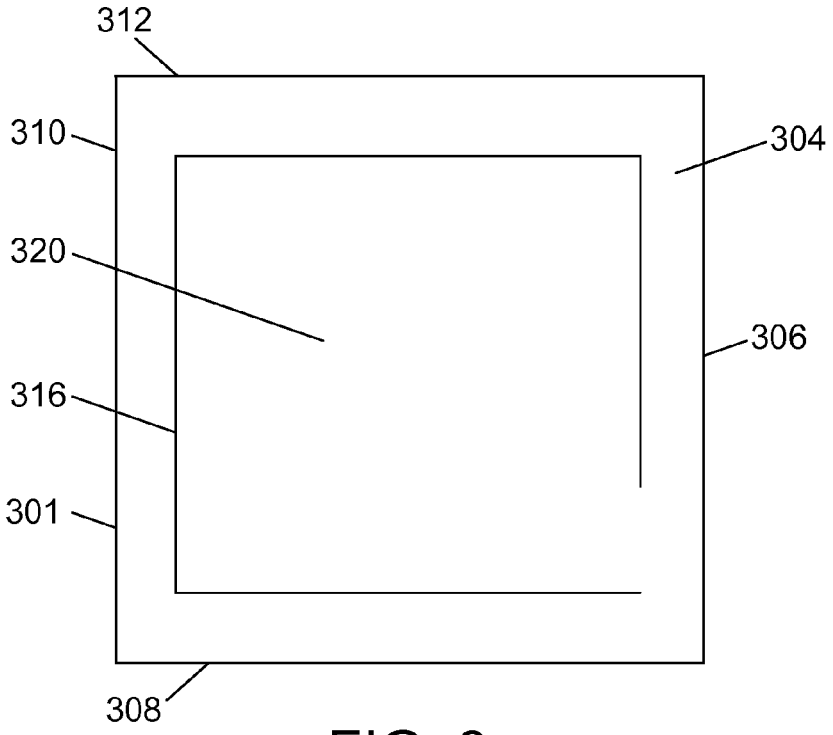
FIG. 8 is a schematic view of a second surface of an exemplary printed circuit board including a second trace.

FIGS. 7 and 8 show yet another alternative embodiment of a multi-band antenna 110 coupled to a PCB, for example, PCB 320. PCB 320 comprises first surface 302 having first trace 314 extending along at least a portion of the length of first side 306, at least a portion of the length of second side 308, at least a portion of the length of fourth side 312, and at least a portion of the length of third side 310. Referring further to FIG. 8, second surface 304 may comprise second trace 316 extending along at least a portion of the length of second side 308, at least a portion of the length of third side 310, at least a portion of the length of fourth side 312, and at least a portion of the length of first side 306.

In a further embodiment, a method for manufacturing a multi-band antenna coupled to a PCB having a perimeter at least partially defined by first side 306, second side 308, and a third side 310. In one embodiment, the method comprises forming first trace 306 of conductive material on first surface 302 of PCB 320, first trace 314 extending along at least a portion of a length of first side 306 proximate perimeter 301 and at least a portion of a length of second side 308 proximate perimeter 301. The method further comprises forming second trace 316 of conductive material on second surface 304 of PCB 320, second trace 316 extending along at least a portion of a length of third side 310 proximate perimeter 301 and at least a portion of a length of second side 308 proximate perimeter 301. In one embodiment, first trace 314 and second trace 316 are etched into PCB 320.

With reference to FIGS. 3-8, any combination of design for first trace 314 and second trace 316 is within the scope of the present disclosure. For example, multi-band PCB antenna 110 may have first surface 302 as shown in FIG. 7, with second surface 304 as shown in FIG. 4.

In one embodiment, manufacturing a printed circuit board antenna, for example, multi-band PCB antenna 110, comprises coupling (e.g., embedding) first trace 314 to first surface 302 of multi-band PCB antenna 110 and coupling second trace 316 to second surface 304 of PCB via, for example, printing, etching, or any suitable coupling method or technique.

As mentioned above, multi-band PCB antenna 110 is capable of achieving multiple band frequencies. However, as one or more dimensions and/or a shape of a PCB (e.g., PCB 320) varies from device to device, and as requirements for particular band frequencies vary, when manufacturing a multi-band PCB antenna, one should take each of the these factors into consideration to produce a multi-band PCB antenna that is capable of achieving multiple band frequencies.

An exemplary process will now be described for manufacturing a multi-band PCB antenna that operates on multiple desired band frequencies.

In one embodiment, a relationship between a return loss (dB) and a maximum available efficiency for a multi-band PCB antenna with a first trace operative in a low frequency band on a first surface of a PCB, and a second trace operative in a high frequency band on a second surface of the PCB opposite the first surface, may be shown as:

$$[\text{Efficiency}=1-(10^{(((return_loss)(dB))/10)})] \quad \text{Equation (1)}$$

Figure 9:
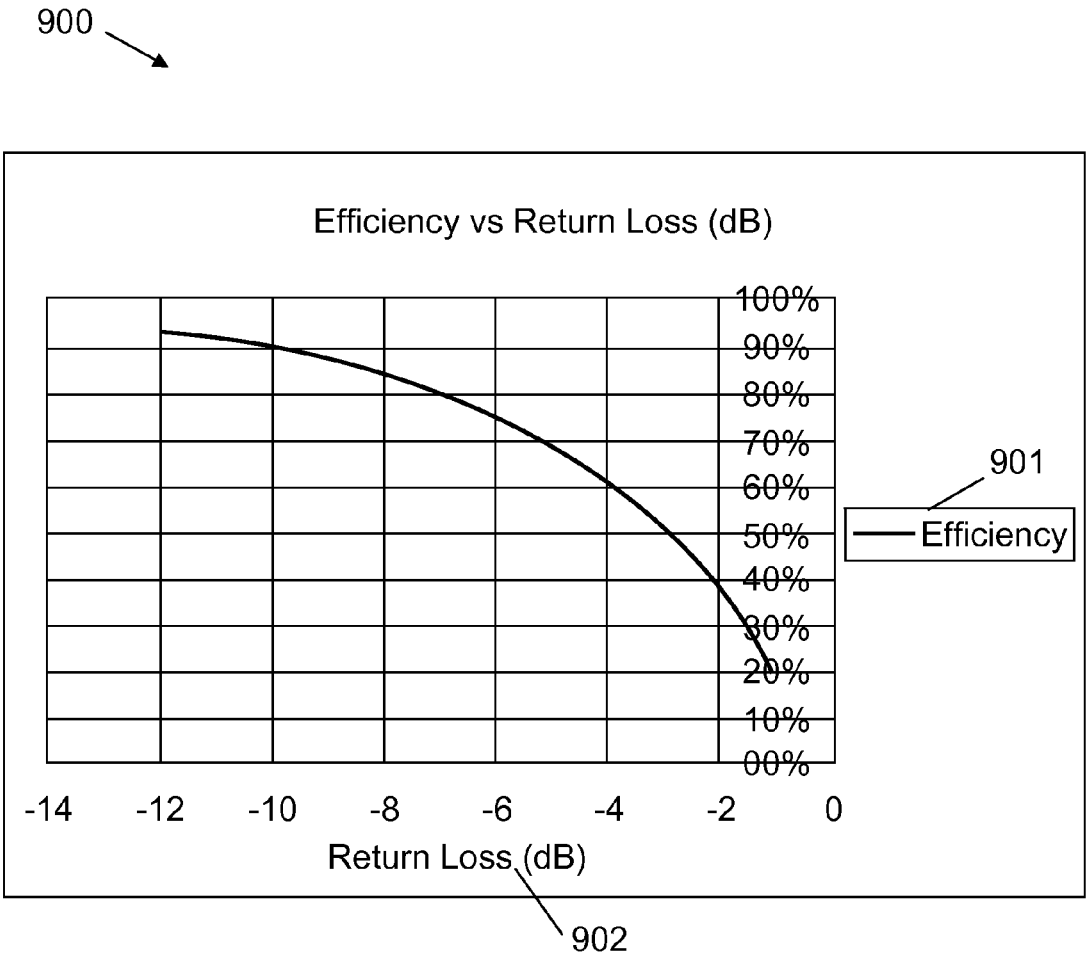
FIG. 9 is a graph showing a maximum available efficiency verses return loss for a multi-band PCB antenna.

FIG. 9 is a graph 900 showing efficiency 901 versus return loss (db) 902. As shown in FIG. 9, a maximum available efficiency rises with an increasing return loss. Therefore, to achieve an efficient multi-band PCB antenna that is capable of communicating in multiple bands, frequencies of interest and bandwidth requirements should be taken into consideration in determining a return loss and an efficiency of a multi-band PCB antenna. An exemplary set of frequencies of interest and bandwidth requirements, as well as the calculated desired return loss and desired efficiency at each corresponding channel in the frequencies of interest is shown in Table 1 below.

TABLE 1

| | Channel | TX (MHz) | RX (MHz) | Desired Return Loss < | Desired Efficiency > |
|---|---|---|---|---|---|
| GSM 850 | 128 | 824 | 869 | −6 | 0.75 |
| | 189 | 836.2 | 881.2 | −6 | 0.75 |
| | 251 | 849 | 894 | −6 | 0.75 |
| GSM 900 | 975 | 880.2 | 925.2 | −6 | 0.75 |
| | 37 | 897.4 | 942.4 | −6 | 0.75 |
| | 124 | 914.8 | 959.8 | −6 | 0.75 |
| DCS 1800 | 512 | 1710 | 1805 | −6 | 0.75 |
| | 698 | 1747.2 | 1842.2 | −6 | 0.75 |
| | 885 | 1785 | 1880 | −6 | 0.75 |
| PCS 1900 | 512 | 1850 | 1930 | −6 | 0.75 |
| | 661 | 1880 | 1960 | −6 | 0.75 |
| | 810 | 1910 | 1990 | −6 | 0.75 |

For example, the first column of Table 1 lists exemplary frequencies of interest, column 2 lists exemplary channels at each of the frequencies of interest, columns 3 and 4 list transmitted frequencies (TX(MHz)) and received frequencies (RX(MHz)), respectively, for each of the corresponding channels in column 2, and columns 5 and 6 list desired return loss and desired efficiency, respectively, for each of the corresponding channels in column 2.

In one embodiment, a design choice is based upon summing or multiplying return loss values over frequencies of interest utilizing GSM, DCS, and PCS standards. Thus, in a case of multiplication (assuming absolute value for clarity) a largest positive number is a "best antenna." In a case of summing, a largest negative value is the "best antenna."

Experiments were constructed for various lengths of a low band first trace, e.g., L1_LB, and high band second trace, e.g., L2_HB (wherein L1 is a length of a first trace, and L2 is a length of a second trace, and LB represents a Low Band and HB represent a High Band). Table 2 (below) provides values for L1 and L2 (where L1 is a length of a first trace, and L2 is a length of a second trace) at the various lengths. Return loss at each frequency was measured for each antenna. Each antenna corresponds to a particular "S" file as shown in table 2 (below), which also provides values for L1_LB and L2_HB at the various lengths. The file name and the results of a return loss at each value of L1_LB and L2_HB at a frequency of 824 MHz are also shown. Return loss can be calculated using the following equation:

$$\begin{aligned} &\text{returnloss}=\text{const}+ \\ &+A*(L1_LB)+B*(L2_HB) \\ &+C*(L1_LB*L2_HB) \\ &+D*(L1_LB\hat{}2)+E(L2_HB\hat{}2) \end{aligned} \quad \text{Equation (2)}$$

TABLE 2

| L1_LB | L2_HB | file | 824.00 MHz |
|---|---|---|---|
| 24.75 | 11.45 | S_1 | −7.36 |
| 25.25 | 11.95 | S_2 | −9.58 |
| 24.25 | 11.95 | S_3 | −7.62 |
| 25.25 | 10.95 | S_4 | −7.84 |
| 24.25 | 10.95 | S_5 | −6.76 |
| 24.75 | 11.45 | S_6 | −8.95 |
| 25.25 | 11.95 | S_7 | −7.87 |
| 24.25 | 11.95 | S_8 | −7.73 |
| 25.25 | 10.95 | S_9 | −7.42 |
| 24.25 | 10.95 | S_10 | −7.87 |
| 24.25 | 10 | S_11 | −7.28 |
| 25.25 | 10 | S_12 | −7.61 |
| 26.25 | 10 | S_13 | −9.75 |
| 26.25 | 10.95 | S_14 | −9.70 |
| 26.25 | 11.95 | S_15 | −11.36 |
| 24.75 | 10.475 | S_16 | −8.36 |
| 25.75 | 10.475 | S_17 | −8.60 |
| 25.75 | 11.45 | S_18 | −9.31 |
| 24.25 | 10 | S_19 | −7.88 |
| 25.25 | 10 | S_20 | −8.06 |
| 26.25 | 10 | S_21 | −8.21 |
| 26.25 | 10.95 | S_22 | −9.48 |
| 26.25 | 11.95 | S_23 | −9.95 |
| 24.75 | 10.475 | S_24 | −8.05 |
| 25.75 | 10.475 | S_25 | −8.45 |
| 25.75 | 11.45 | S_26 | −9.38 |

The coefficients A, B, C, D, and E in Tables 3 and 4 (below) were determined (e.g., utilizing Equation 2) by a least squared error fit to the measured return loss data.

TABLE 3

| | Freq (MHz) | | | | | | | | | |
|---|---|---|---|---|---|---|---|---|---|---|
| | 824 | 836.5 | 849 | 869 | 880.2 | 897.4 | 914.6 | 920 | 959.6 | 960 |
| const | −354.30 | −196.80 | −196.80 | 69.40 | 918.50 | 802.20 | 540.30 | 480.70 | 198.40 | 189.10 |
| A | 22.25 | 13.77 | 13.77 | −1.88 | −57.07 | −48.78 | −36.39 | −34.40 | −17.98 | −17.18 |
| B | 14.78 | 5.75 | 5.75 | −6.22 | −37.14 | −38.35 | −19.27 | −13.49 | 1.39 | 1.29 |
| C | −0.43 | −0.06 | −0.06 | 0.30 | 1.40 | 1.01 | 0.47 | 0.36 | −0.01 | −0.01 |

TABLE 3-continued

| | Freq (MHz) | | | | | | | | | |
|---|---|---|---|---|---|---|---|---|---|---|
| | 824 | 836.5 | 849 | 869 | 880.2 | 897.4 | 914.6 | 920 | 959.6 | 960 |
| D | −0.37 | −0.28 | −0.28 | −0.06 | 0.81 | 0.76 | 0.64 | 0.62 | 0.38 | 0.36 |
| E | −0.20 | −0.21 | −0.21 | −0.08 | 0.11 | 0.62 | 0.37 | 0.23 | −0.04 | −0.03 |

TABLE 4

| | Freq (MHz) | | | | | | | |
|---|---|---|---|---|---|---|---|---|
| | 1710 | 1747.4 | 1785 | 1795 | 1805 | 1843 | 1850 | 1880 |
| const | 2734.20 | 1522.80 | 701.50 | 654.30 | 651.20 | 776.00 | 812.20 | 1150.60 |
| A | −162.91 | −100.71 | −50.73 | −47.81 | −47.73 | −53.13 | −55.20 | −82.22 |
| B | −122.81 | −49.77 | −14.81 | −13.12 | −12.73 | −23.12 | −25.23 | −28.99 |
| C | 3.84 | 1.55 | 0.46 | 0.39 | 0.39 | 0.62 | 0.68 | 0.79 |
| D | 2.37 | 1.67 | 0.91 | 0.87 | 0.87 | 0.92 | 0.95 | 1.49 |
| E | 1.14 | 0.51 | 0.19 | 0.19 | 0.17 | 0.37 | 0.40 | 0.48 |

The rows in Table 3 and Table 4 represent regression components of the coefficients A, B, C, D, and E. The columns in Table 3 and Table 4 are frequencies in Megahertz (MHz). Table 3 and Table 4 illustrate calculated regression components, which indicate a sensitivity of the components to return loss to determine a sensitivity of an antenna corresponding to a change in length, for example, L1_LB and L2_HB, which are the lengths of, for example, first trace 314 and second trace 316 on a respective side of multi-band PCB antenna 110.

Figure 10:
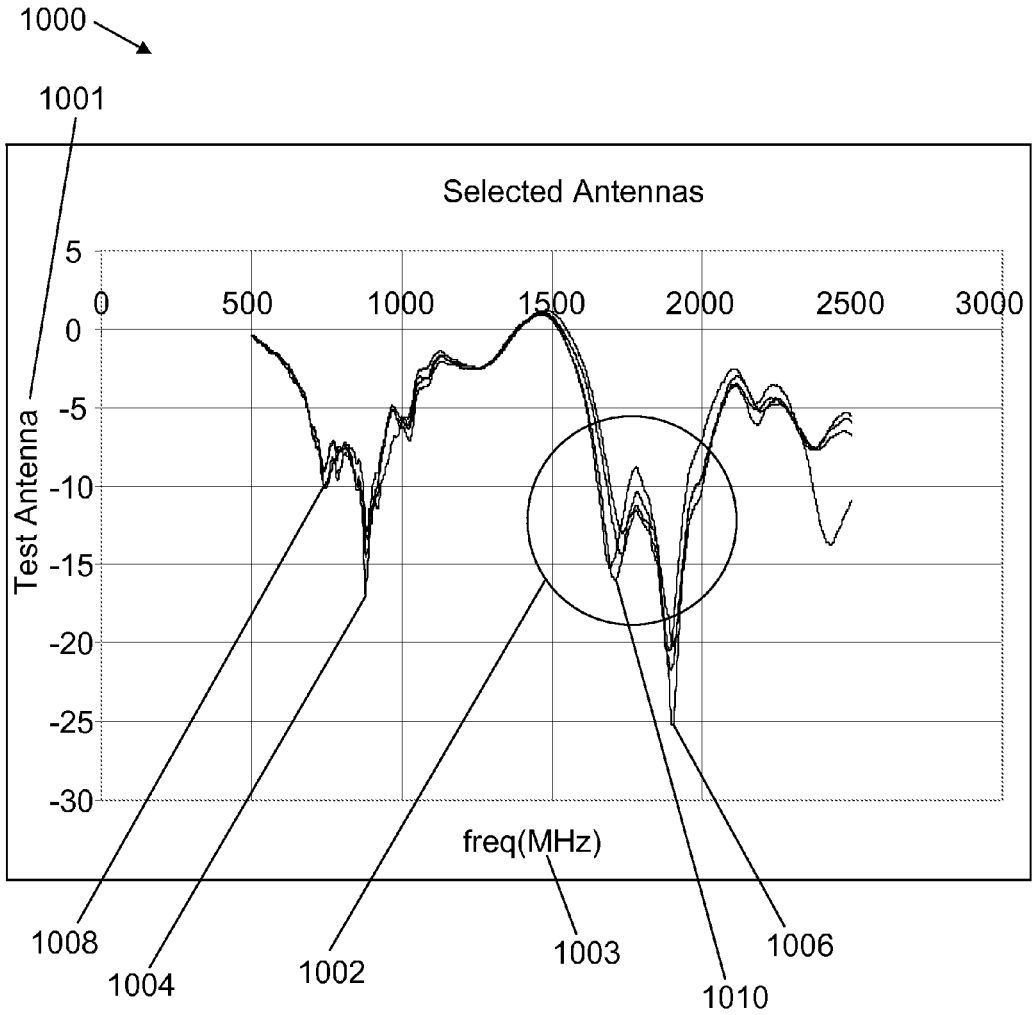
FIG. 10 is a graph showing return loss measurements.

Table 3 and Table 4 can be extended by fitting a model for frequency at every frequency of interest and varying L1_LB and L2_LB in a parametric way to find a combination with a best return loss over a frequency range of interest, as shown in FIG. 10. For example, in Table 3, a production variation of a multi-band PCB antenna etching process is assumed to be 0.001 inches=1 mil.

Figure 11:
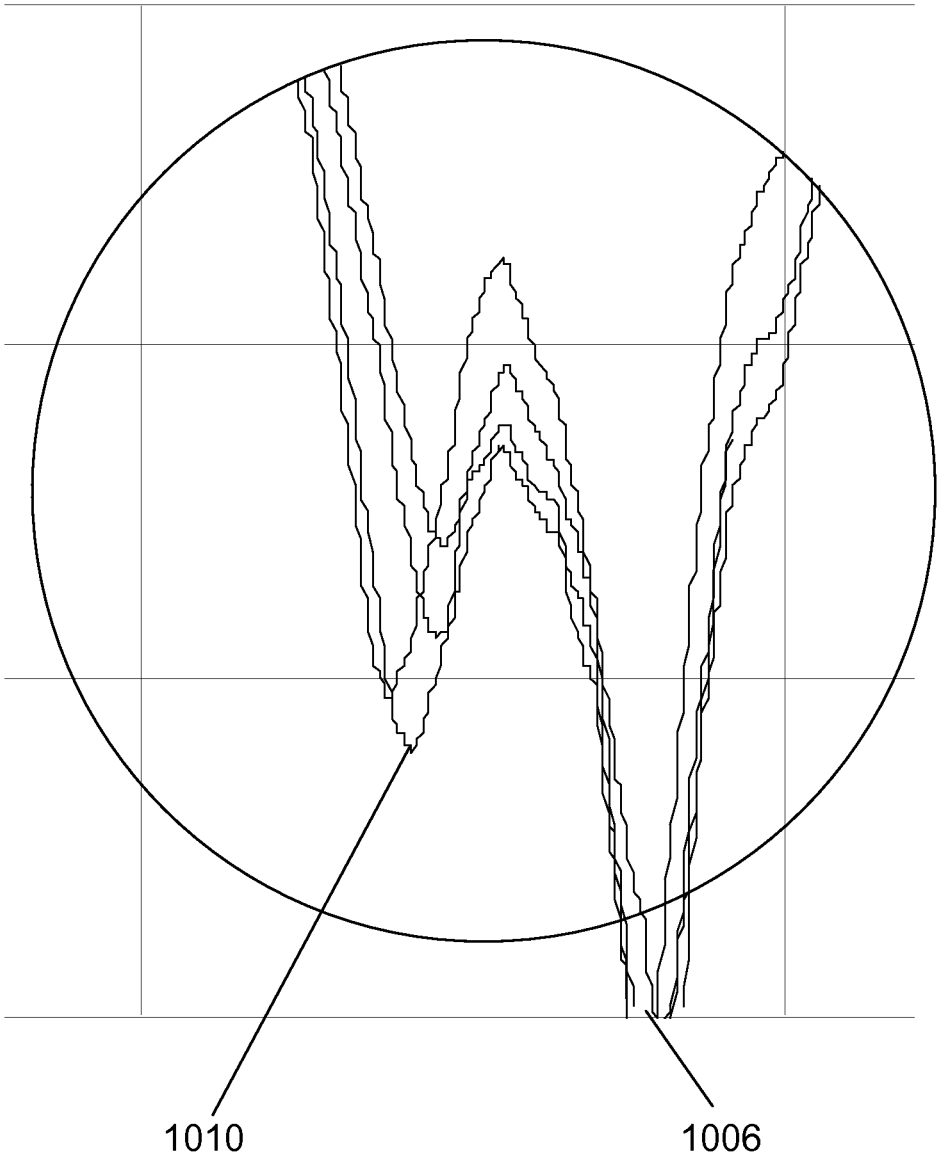
FIG. 11 is a portion of the graph shown in FIG. 10.
Figure 12:
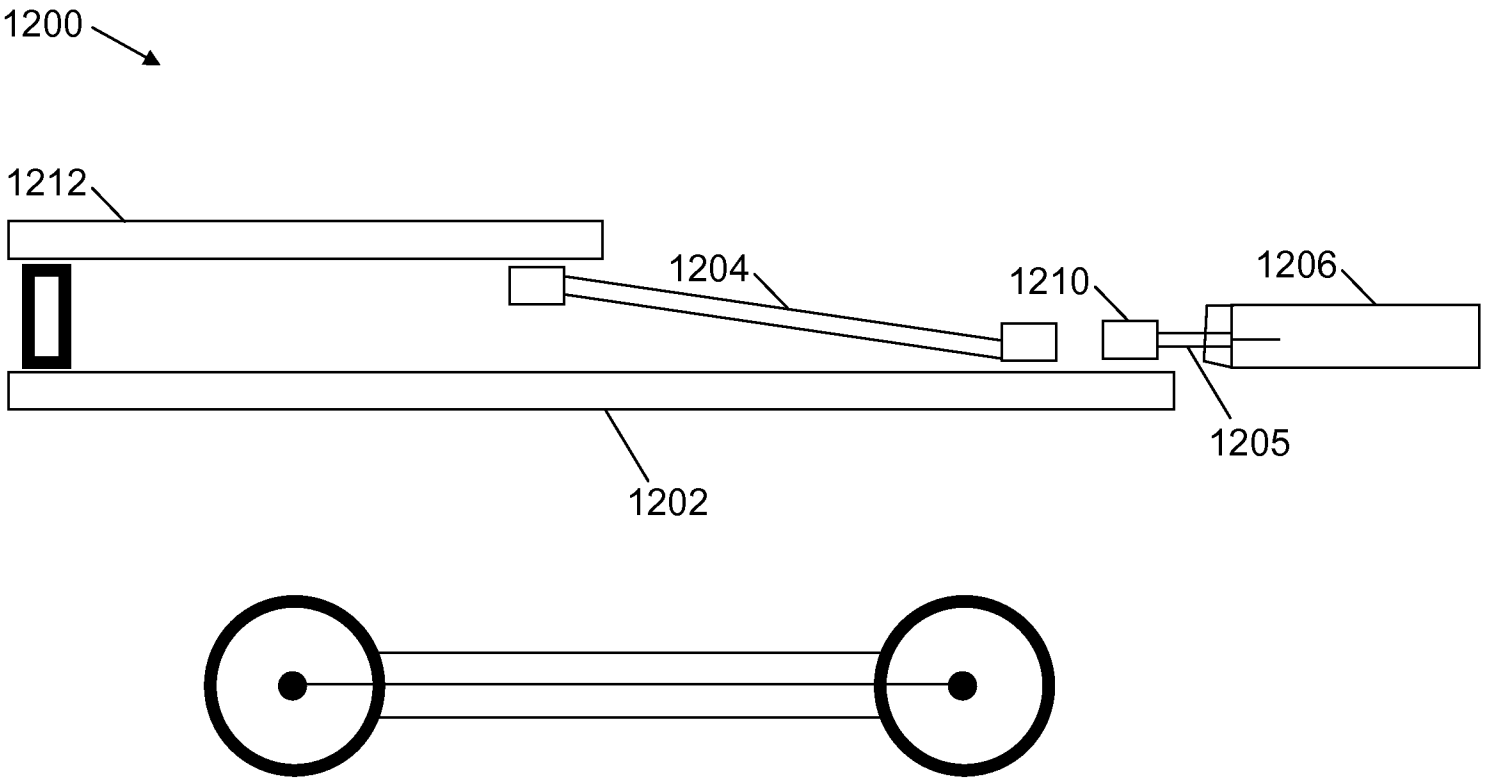
FIG. 12 (PRIOR ART)
FIG. 12 is an illustrative example of a conventional apparatus designed to transfer a ground to a motherboard.

FIG. 10 is a graph 1000 showing return loss measurements of selected test antennas 1001 verses frequency 1003 for a selected set of test antennas (e.g., FIG. 10 illustrates four curves represented by four selected antennas (e.g., four "S" files) in Table 2). As mentioned above, coupling that occurs between a low band arm and a high band arm (e.g., first trace 314 and second trace 316) causes mode splitting, which is shown, for example, at graph area 1002 and in FIG. 11, which is a magnification of graph area 1002. Due to mode splitting, a low band arm resonance 1004 and a high band arm resonance 1006 actually become four resonances 1004, 1006, 1008, and 1010, for example; two closely tuned low band resonances and two closely tuned high band resonances. Thus, unlike conventional multi-band PCB antennas that can only be reduced to a particular size because the antenna is unable to achieve a proper bandwidth when the antenna is too small, overlap between the low band arm and the high band arm provides coupling, and therefore will result in mode splitting which allows the low band arm and the high band arm to appear wider, thereby increasing the bandwidth. Therefore, a smaller, more narrow multi-band PCB antenna, which may have been unable to achieve proper bandwidth conventionally, by the embodiments described herein is able resonate between bands of interest, for example, between about 824 MHz to about 960 MHz, and from about 1710 MHz to about 1990 MHz, as shown at resonant points 1004 and 1006, the lowest points on the graph in FIG. 10.

Radio and Motherboard Stack Analysis

To overcome the deficiencies described above with the conventional apparatus, the embodiments described herein for transferring a ground to a motherboard not only capacitively couple the grounds between a radio and a motherboard, provide mechanical restraint for an antenna, and increase capacitive coupling to ground and, thus, reduce series inductance along an outside of coax cable, but also require only one coax cable which reduces the cost to nearly one half of a cost of conventional apparatus which require two coax cables.

Figure 13:
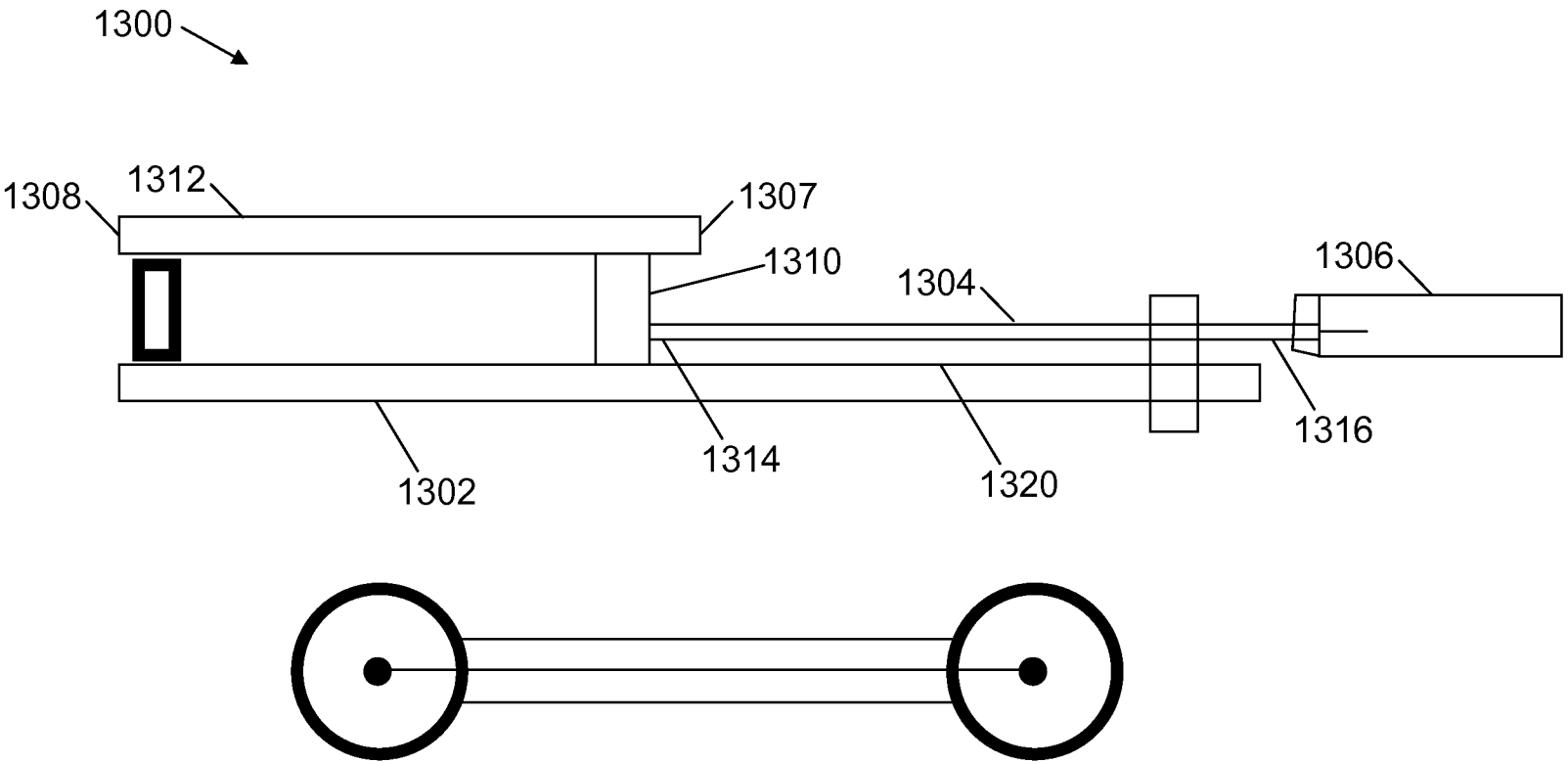
FIGS. 13 and 14 are illustrative examples of an exemplary apparatus for transferring a ground to a motherboard in accordance with embodiments of the present disclosure.

FIG. 13 is an example of an apparatus 1300 for transferring a ground to a motherboard 1302. Apparatus 1300 comprises motherboard 1302, a radio 1312 having a first end 1307 and a second end 1308, and a first connector 1310 (e.g., radio frequency connector) proximate first end 1307 of radio 1312. First connector 1310 is configured to couple radio 1312 and motherboard 1302. Apparatus 1300 further comprises a coax cable 1304 having a first end 1314 coupled to radio 1312. First connector 1310 and an opposing second end 1316, and an antenna 1306 (e.g. multi-band PCB antenna 110) coupled to second end 1316 of coax cable 1304.

In one embodiment, radio frequency ground currents are transferred to a top edge 1320 of motherboard 1302 through direct contact with coax cable 1304. For example, at least a portion of a length of coax cable 1304 may be in direct contact with motherboard 1302. In one embodiment, coax cable 1304 may be secured to motherboard 1302 to increase capacitive coupling to ground and, thus, reduce series inductance along the outside of coax cable 1304.

In one embodiment, antenna 1306 can be coupled to second end 1316 of coax cable 1304 with a ground pad solder point on a base of antenna 1306 for mechanical restraint, although other coupling means are also possible.

In one embodiment, first connector 1310 is in physical contact with each of radio 1312 and motherboard 1302 and, thus, capacitively couples the grounds between radio 1312 and motherboard 1302. In one embodiment, radio 1312 is secured to motherboard 1302 with any suitable fastener, for example, a screw.

Figure 14:
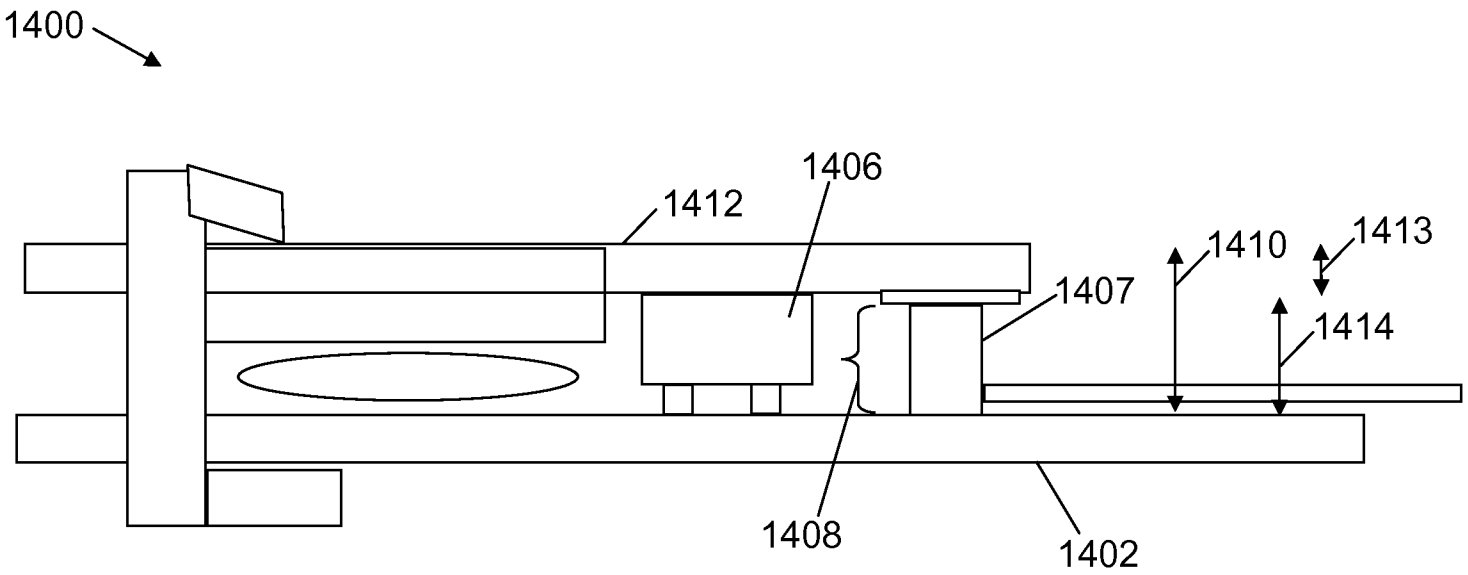

FIG. 14 shows a more detailed example of an apparatus 1400 for transferring a ground to a motherboard 1402. For example, FIG. 14 shows components between a radio 1412 and motherboard 1402. One advantage of apparatus 1400 is that apparatus 1400 provides direct/indirect physical contact with each component to radio 1412 and/or motherboard 1402.

For example, a distance between radio 1412 and motherboard 1402 is configured to allow a battery 1406 to have direct physical contact with radio 1412 and motherboard 1402.

To achieve a distance between radio 1412 and motherboard 1402 that enables physical contact with one or more components between radio 1404 and motherboard 1402, in one embodiment, a connector 1407 (for example, a radio frequency connector) has a connector height 1408 less than a maximum height of battery 1406. In a further embodiment, connector height 1408 equals a total height 1410 minus a radio thickness 1413. In yet another embodiment, connector height 1408 is greater than a gap 1414 (e.g., a distance between radio 1412 and motherboard 1402), and is also equal to total height 1410 minus radio thickness 1413. In a further embodiment, total height 1410 minus radio thickness 1413 minus connector height 1408 is greater than zero.

This written description uses examples to disclose the invention, including the best mode, and also to enable any person skilled in the art to practice the invention, including making and using any device or system and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A multi-band antenna for a printed circuit board (PCB), said multi-band antenna comprising:

a first trace coupled to a first surface of the PCB and extending along at least a portion of a length of a first side of the PCB and along at least a portion of a length of a second side of the PCB intersecting the first side, the first trace positioned proximate a perimeter of the PCB partially defined by the first side and the second side; and a second trace coupled to a second surface of the PCB and extending along at least a portion of a length of a third side of the PCB intersecting the second side and partially defining the perimeter and along at least a portion of the length of the second side, the second trace positioned proximate the perimeter of the PCB.

2. A multi-band antenna in accordance with claim 1, wherein the first trace overlaps a portion of the second trace to allow coupling between the first trace and the second trace, the coupling enabling a splitting of resonance and mode.

3. A multi-band antenna in accordance with claim 1, wherein the first trace further extends along at east a portion of a fourth side of the PCB intersecting the first side and partially defining the perimeter.

4. A multi-band antenna in accordance with claim 3, wherein the first trace further extends along at least a portion of the length of the third side.

5. A multi-band antenna accordance with claim 3, wherein the second trace further extends along at least a portion of the length of the fourth side.

6. A multi-band antenna in accordance with claim 5, wherein the second trace further extends along at least a portion of the length of the first side.

7. A multi-band antenna in accordance with claim 1, wherein the first trace is operative in a low frequency band.

8. A multi-band antenna in accordance with claim 7, wherein the second trace is operative in a high frequency band.

9. A communication device, comprising:

a printed circuit board (PCB) having a perimeter at least partially defined by a first side, a second side, and a third side; and an antenna coupled to the PCB, the antenna comprising:

a first trace of conductive material coupled to a first surface of the PCB, the first trace extending along at least a portion of a length of the first side proximate the perimeter and at least a portion of a length of the second side proximate the perimeter; and a second trace of conductive material coupled to a second surface of the PCB opposing the first surface, the second trace extending along at least a portion of a length of the third side proximate the perimeter and along at least a portion of the length of the second side proximate the perimeter.

10. A communication device in accordance with claim 9, wherein the communication device is at least one of a cellular telephone, a mobile data terminal, a two-way radio a personal digital assistant, a handheld computer, a laptop computer, a notebook computer, a wireless email device, and a two way messaging device.

11. A communication device in accordance with claim 9, wherein the first trace is operative in at least a first frequency band and the second trace is operative in at least a second frequency band different from the first frequency band.

12. A communication device in accordance with claim 9, wherein the first trace and the second trace overlap to allow an inductive coupling between the first trace and the second trace.

13. A communication device in accordance with claim 9, wherein the first trace further extends along at least a portion of a length of a fourth side proximate the perimeter.

14. A communication device in accordance with claim 13, wherein the first trace further extends along at least a portion of a length of the third side proximate the perimeter.

15. A communication device in accordance with claim 13, wherein the second trace further extends along at least a portion of a length of the fourth side proximate the perimeter.

16. A communication device in accordance with claim 13, wherein the second trace further extends along at least a portion of a length of the first side proximate the perimeter.

17. A method for manufacturing a multi-band antenna coupled to a printed circuit board (PCB) having a perimeter at least partially defined by a first side, a second side, and a third side, said method comprising:

forming a first trace of conductive material on a first surface of the PCB, the first trace extending along at least a portion of a length of the first side proximate the perimeter and at least a portion of a length of the second side proximate the perimeter; and forming a second trace of conductive material on a second surface of the PCB, the second trace extending along at least a portion of a length of the third side proximate the perimeter and at least a portion of a length of the second side proximate the perimeter.

18. A method in accordance with claim 17, further comprising etching the first trace and the second trace into the PCB.

* * * * *